United States Patent [19]

Takahashi

[11] Patent Number: 4,488,338

[45] Date of Patent: Dec. 18, 1984

[54] SEALING SLIDE FASTENER STRINGER

[75] Inventor: Kihei Takahashi, Uozu, Japan

[73] Assignee: Yoshida Kogyo K. K., Tokyo, Japan

[21] Appl. No.: 410,129

[22] Filed: Aug. 20, 1982

[30] Foreign Application Priority Data

Aug. 20, 1980 [JP] Japan ..... 56-129439

[51] Int. Cl.[3] ..... A44B 19/32

[52] U.S. Cl. ..... 24/389; 24/408

[58] Field of Search ..... 24/205.1 R, 205.16 R

[56] References Cited

U.S. PATENT DOCUMENTS

| | | | |
|---|---|---|---|
| 2,174,159 | 9/1939 | Marinsky | 24/205.1 R |
| 2,775,012 | 12/1956 | Mulka | 24/205.1 R |
| 2,791,017 | 5/1957 | Mulka | 24/205.1 R |
| 3,037,255 | 6/1962 | Ryser | 24/205.1 R |
| 3,130,465 | 4/1964 | Ryser | 24/205.1 R |
| 3,757,391 | 9/1973 | Cuckson et al. | 24/205.1 R |

FOREIGN PATENT DOCUMENTS

| | | | |
|---|---|---|---|
| 950992 | 10/1956 | Fed. Rep. of Germany | 24/205.1 R |
| 1277959 | 10/1961 | France | 24/205.1 R |

*Primary Examiner*—William E. Lyddane
*Assistant Examiner*—Peter A. Aschenbrenner
*Attorney, Agent, or Firm*—Hill, Van Santen, Steadman & Simpson

[57] ABSTRACT

A water-tight, air-tight or otherwise sealing slide fastener has a series of discrete coupling elements secured to a support tape, a connecting cord extending longitudinally through and interconnecting the series of individual elements in equally spaced relation and a series of sealing strips each clamping a region of the tape which is folded around the elements. The connecting cord is dimensioned to fill the interspaces between adjacent elements so as to prevent entry of foreign matter.

1 Claim, 11 Drawing Figures

SEALING SLIDE FASTENER STRINGER

BACKGROUND OF THE INVENTION

1. Field of the Invention

This invention relates to the art of slide fasteners and more particularly to a slide fastener stringer which is made air-tight or water-tight to suit applications such as in wet-suits, fishing boots, and other water-proof articles.

2. Prior Art

There are known numerous slide fasteners of a water-tight or air-tight construction, a typical example of which comprises, as disclosed in British Pat. No. 723,998, a pair of support tapes each carrying a series of discretely arranged coupling elements, the tape material being folded around the major portions of the elements. The elements thus masked by the tape material are further enveloped by sealing strips or stirrups to make the fastener watertight. This enveloping operation has encountered considerable difficulty in that failure to maintain the individual fastener elements in equally spaced-apart relation or to support them stably in position on the tapes would make it difficult to register the stirrup with the elements to be enveloped. Furthermore, unfilled spaces between the elements and the tapes would invite entry of foreign matter which would interfere with normal coupling and uncoupling performance of the fastener stringer.

SUMMARY OF THE INVENTION

The present invention provides an improved water-tight or air-tight slider fastener stringer which comprises a pair of support tapes each having a series of coupling elements interconnected by a connecting cord member extending longitudinally of the tape.

It is a primary object of the present invention to eliminate the aforesaid difficulties of the prior art.

It is a specific object of the invention to provide a water-tight, air-tight or otherwise sealing slide fastener which has a structural feature to prevent intrusion of foreign matter into the interspaces between adjacent coupling elements.

It is another object of the invention to provide a water-tight or air-tight slide fastener which has a series of coupling elements equally spaced apart and stably mounted on a support tape so that each individual element can be assembled in registry with a mating sealing strip.

These and other objects and features of the invention will become apparent from the following description taken in conjunction with the accompanying drawings which show by way of example certain preferred embodiments.

DETAILED DESCRIPTION

Figure 1:
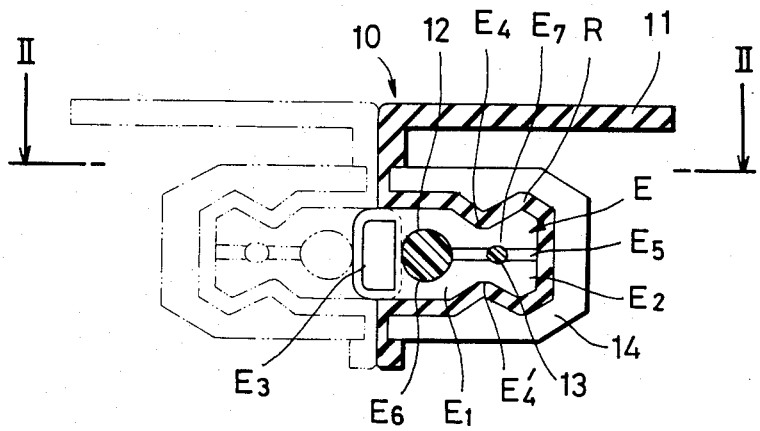
FIG. 1 is an end elevational, partly cross-sectional view of a pair of slide fastener stringers shown coupled together according to the invention.
Figure 2:
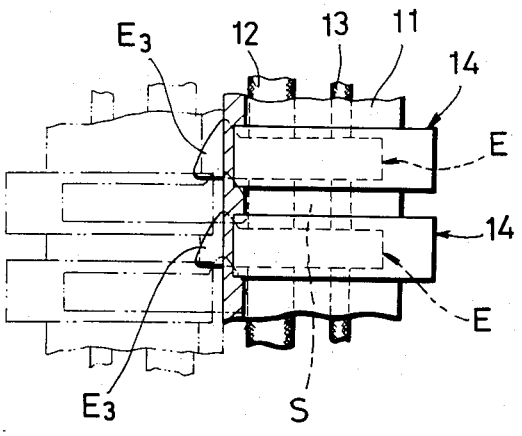
FIG. 2 is a fragmentary cross-sectional view taken along the line II—II of FIG. 1.
Figure 3:
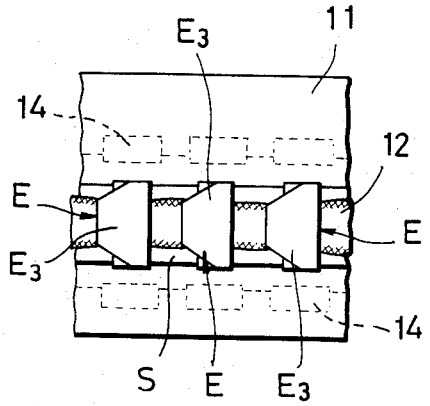
FIG. 3 is a side elevation of FIG. 1 showing one of a pair of stringers.
Figure 4:
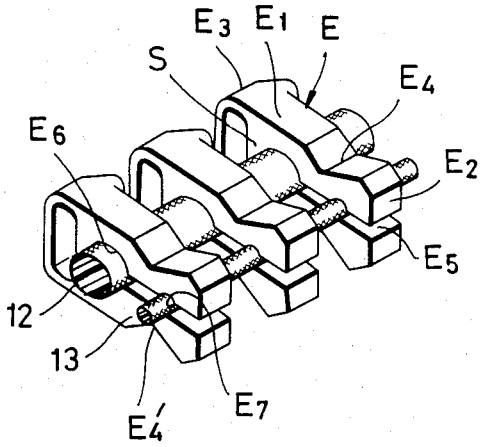
FIG. 4 is a fragmentary perspective view of a series of coupling elements interconnected by connecting cords.

FIGS. 1 through 5 inclusive illustrate a preferred embodiment of the invention. FIG. 1 shows a pair of fastener stringers, one being shown in imaginery lines. As both stringers are identical in form and construction, the description of one such stringer should suffice. A stringer generally designated 10 comprises a support tape 11 made of a fluid tight material such as naturally occurring or synthetic rubber, or naturally occurring or synthetic fibers coated with rubber or other suitable fluid tight materials. A series of discrete coupling elements E is secured to the tape 11 by means of a sealing strip later described. Each element E has a base portion $E_1$, a foot portion $E_2$ and a coupling head portion $E_3$. The material of the tape 11 is folded around the base $E_1$ and the foot $E_2$ of the element E, with the coupling head $E_3$ exposed for engagement with a corresponding coupling head on the mating stringer. The element E has a pair of recesses $E_4$,$E_4'$ symmetrically disposed in the upper and lower surfaces between the base $E_1$ and the foot $E_2$. The element E has an elongated slit $E_5$ extending lengthwise of the element and splitting the foot $E_2$ apart as better shown in FIG. 4. A pair of apertures $E_6$ and $E_7$ substantially circular in cross section is formed in communication with the slit $E_5$, the first or large aperture $E_6$ being located in the base $E_1$ adjacent to the coupling head $E_3$ and the second or small aperture $E_7$ being located adjacent to the foot $E_2$.

In accordance with an important aspect of the invention, there is at least one connecting cord 12 made of a flexible material such as nylon, polyester and similar synthetic fibers in the form of mono-filament, twisted yarn or sliver. This cord 12 is slightly larger in diameter than but dimensioned to be receptive in and through the first apertures $E_6$. The cord 12 serves to retain the series of elements E in equally spaced relation during assembly with a sealing strip 14 (FIG. 1) and also to fill the interspaces S (FIG. 4) between adjacent elements which could otherwise entrap foreign matter.

There may be used another connecting cord 13 which is of the same material as but is smaller in diameter than the first cord 12. This cord 13 is received in and through the second apertures $E_7$ thereby retaining the elements E in correct posture and ensuring stabilized coupling and uncoupling operation of the fastener. The connecting cords 12,13 being flexible serve to disperse the stress which would otherwise concentrate on and loosen up the joint between the sealing strip 14 and a folded region R (FIG. 1) of the tape 11.

Figure 5:
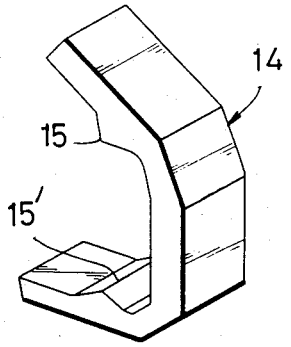
FIG. 5 is a perspective view on an enlarged scale of a sealing strip employed in accordance with the invention.

FIG. 5 shows a sealing strip 14 which is generally in the form of a stirrup and which has an inner surface contour complimentary in shape with the outer peripheral surfaces of the base and foot portions $E_1$ and $E_2$ of the element E. The sealing strip 14 has a pair of projections 15,15' shaped complemental in contour with the recesses $E_4$,$E_4$ of each individual element E. The sealing strip 14 is clamped under pressure over the region R (FIG. 1) of the support tape 11 which is folded around the base and foot portions $E_1$ and $E_2$ of the element, so that the tape material is firmly gripped between the element E and the strip 14 and anchored in place stably, particularly at the position of the recesses $E_4$,$E_4'$. The strip 14 may be preferably made of a mechanically strong metal, urethane or other plastic material. When the two stringers 10 are coupled by the action of a slider (not shown) in a well known manner, they are sealed by a continuous joint formed by the abutting inner edge of the respective confronting tapes 11.

Figure 6:
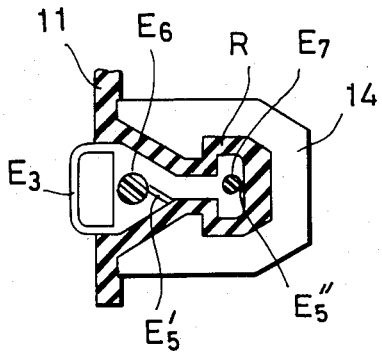
FIG. 6 is an end elevation of a modified form of an element-and-sealing strip assembly.

FIG. 6 shows a modification of an element-and-strip assembly in which there are provided two separate slits $E_5'$ and $E_5''$ communicating with the apertures $E_6$ and $E_7$, respectively, the other structural details being substantially similar to those of the basic embodiment described above. This modification is suitable for a relatively small coupling element.

Figure 7:
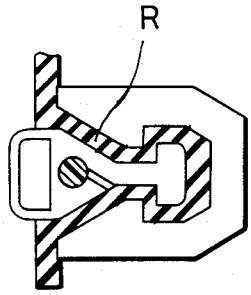
FIG. 7 is an end elevation of another modification.

FIG. 7 shows another modification which is similar to that of FIG. 6 except for the exclusion of the second connecting cord 13. This modification is suitable for use in an air-tight medical oxygen supply tent where there is encountered a relatively small pressure in the coupling operation of the fastener.

Figure 8:
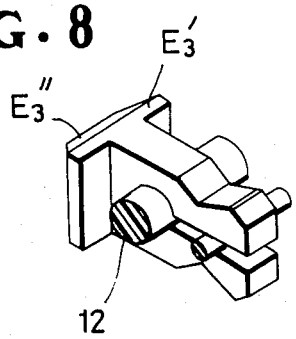
FIG. 8 is a perspective view of a coupling element having a modified form of coupling head.
Figure 9:
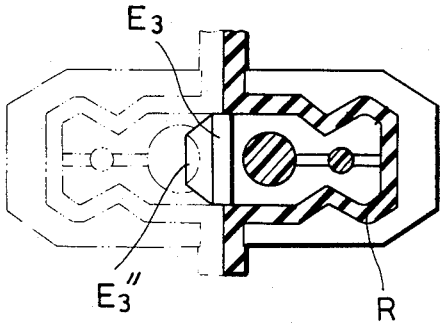
FIG. 9 is an end elevation of a pair of fastener stringers shown coupled together in which the element of FIG. 8 is used.

FIG. 8 shows a modified form of a coupling element E which is characterized by the provision of a T-shaped coupling head $E_3'$ having a projection $E_3''$ engageable with and pressing the cord 12 in the mating element to deform the cord slightly as illustrated in FIG. 9, thereby enhancing the strength of coupling between the stringers.

Figure 10:
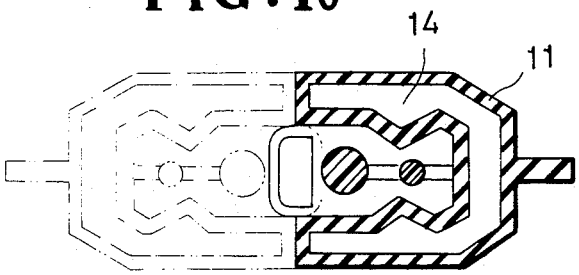
FIG. 10 is an end elevation of a pair of modified fastener stringers shown coupled together in which the sealing strip is further covered by the tape material.

FIG. 10 shows a further modification in which the sealing strip 14 is enveloped by the tape material, the resulting stringer being suitable for engagement by a slider of the type disclosed for example in Japanese Patent Publication No. 38-20174. The structure of FIG. 10 is diagrammatic and can be assembled as shown in FIGS. 40 or 44 of said Japanese Publication.

Figure 11:
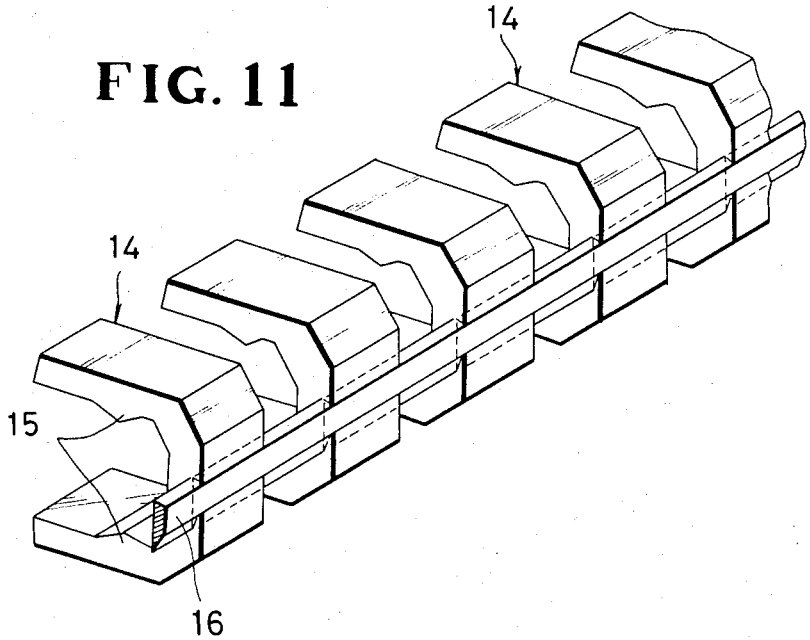
FIG. 11 is a perspective view of a modified form of sealing strip.

FIG. 11 shows a modification of the sealing strip 14 in which a series of strips 14 is interconnected by a resilient connecting member 16 and retained thereby at spaced-apart intervals in registration with the pitch of the series of elements E. This modification is advantageous in that fastener stringers of this type can be fabricated with greater ease and with accuracy as regards the positional relationship between the elements E and the strips 14.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A sealing slide fastener stringer comprising:

(a) a support tape made of a fluid-tight material;

(b) a series of discrete coupling elements made of metal and mounted on said support tape along a longitudinal edge portion thereof, each of said coupling elements including a base, a foot and a head portion, each said coupling element having a pair of recesses disposed between said base and foot portions;

(c) said longitudinal edge portion of said support tape being folded so as to provide therealong a contact portion adapted to engage a corresponding contact portion of a like companion stringer to effect a fluid-tightness between such two stringers, said longitudinal edge portion extending around said base portion of each said coupling element;

(d) a connecting cord made of flexible material and interconnecting said series of coupling elements in uniformly spaced relation, said connecting cord extending through said base portion of each said coupling element, portions of said cord lying between adjacent coupling elements being engageable with the head portions of a corresponding mating stringer;

(e) a series of generally U-shaped sealing strips made of metal, each strip surrounding the folded edge portion of said support tape over said base and foot portions of a respective one of said coupling elements, each said sealing strip having on its inner surface a pair of opposed projections received one in each said recess of said base portion of the respective coupling elements; and (f) an elongated resilient connecting member interconnecting said series of sealing strips in uniformly spaced relation in registration with the pitch of said series of coupling elements.

* * * * *